United States Patent [19]

Roberts et al.

[11] Patent Number: 4,834,583

[45] Date of Patent: May 30, 1989

[54]. METHOD FOR INSTALLING A HOLLOW PIPE

[75] Inventors: David L. Roberts; Ronald A. Lieffering, both of Rijswijk, Netherlands

[73] Assignee: Shell Oil Company, Houston, Tex.

[21] Appl. No.: 230,732

[22] Filed: Aug. 8, 1988

Related U.S. Application Data

[63] Continuation of Ser. No. 081,385, Aug. 4, 1987, abandoned.

[30] Foreign Application Priority Data

Aug. 14, 1986 [GB] United Kingdom ..... 8619785

[51] Int. Cl.[4] ..... E02D 5/26

[52] U.S. Cl. ..... 405/263; 166/295; 405/232; 405/264

[58] Field of Search ..... 405/232, 233, 263, 264, 405/244; 166/295, 285; 264/164; 525/510, 523, 528, 533; 528/109, 387

[56] References Cited

U.S. PATENT DOCUMENTS

| | | | |
|---|---|---|---|
| 2,428,070 | 9/1948 | Frenkil | 405/250 X |
| 3,306,355 | 2/1967 | Maly | 166/29 |
| 3,324,665 | 6/1967 | Robichaux et al. . | |
| 3,354,657 | 11/1967 | Torzillo | 405/244 |
| 3,636,717 | 1/1972 | Pogonowski . | |
| 3,677,113 | 7/1972 | Bowles . | |
| 4,331,722 | 5/1982 | Packo et al. | 428/35 |
| 4,370,078 | 1/1983 | Gadelle et al. | 405/264 |
| 4,543,764 | 10/1985 | Kozikowski | 405/216 X |
| 4,618,289 | 10/1986 | Federer | 405/241 X |

*Primary Examiner*—Dennis L. Taylor

[57] ABSTRACT

The present invention relates to stabilizing a structure embedded in an earth formation by disposing the solidifiable liquid resin composition between at least an external portion of the structure and the surrounding earth formation, and solidifying the resin composition in intimate and static contact with both the structure and the formation, whereby the solidified resin is bonded to both the structure and the formation.

The liquid thermosetting resin-forming composition contains 10–50%v polyglycidylether of 2,2-bis(4-hydroxyphenyl)propane, 10–88%v ethylacetate, 0–78%v butoxyloxitol, 2–20%v diethanoltriamine, 0–78%v xylene and 0–15%v dimethylaminomethylphenol.

5 Claims, 1 Drawing Sheet

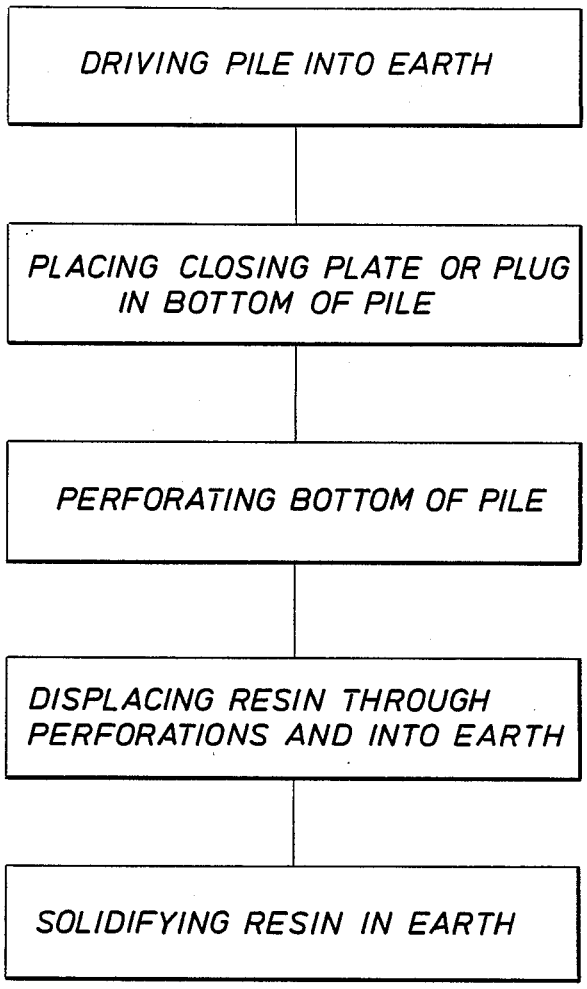
DRIVING PILE INTO EARTH
PLACING CLOSING PLATE OR PLUG IN BOTTOM OF PILE
PERFORATING BOTTOM OF PILE
DISPLACING RESIN THROUGH PERFORATIONS AND INTO EARTH
SOLIDIFYING RESIN IN EARTH

METHOD FOR INSTALLING A HOLLOW PIPE

This is a continuation of application Ser. No. 81,385, filed Aug. 4, 1987, now abandoned.

BACKGROUND OF THE INVENTION

This invention relates to a process for installing and stabilizing piles in earth formations. More particularly, the invention is directed to a method for stabilizing and increasing the load bearing capacity, especially with respect to the pull-out resistance or resistance to settlement, of piles, such as those used to support or stabilize offshore structures and drilling platforms. The invention is especially useful in processes in which hollow piles aare embedded in earth formations and stabilized by emplacing and solidifying liquids within radial zones that extend from within the piles out into the surrounding earth formations.

There is frequent need for stationary foundations or pile structures, that will neither yield to the weight of any superstructure placed thereon nor yield to external pull-out forces. The problem of providing such a pile structure becomes especially difficult when it is desired to erect a superstructure above an earth stratum consisting of incompetent earth formations such as loose or sandy earth. Such formations tend to require the driving of very long piles to provide the required load carrying capacity. For example, in the oil industry, serious problems haven arisen in connection with the stabilization of pile structures used to support offshore drilling and production platforms, when such pile structures are embedded in incompetent earth formations on the ocean floor. In addition to the weight of the platform structures per se, the pile structures must be able to withstand the extreme pull-out forces resulting from the constant pounding and overturning forces of water waves and currents against the platform. More recently, such platforms have been subjected to even more violent pull-out forces due to the action of ice-flow in certain arctic regions.

In the ordinary smooth-walled pile an upward axial stress is transmitted to the earth largely or wholly by skin friction. These piles are "driven to refusal," i.e., driven to a depth at which the skin friction and the load-bearing capacity of the formations penetrated becomes sufficient to resist further penetration in response to the driving force. It is also known to form projections or footings on embedded pile structures to act as anchoring means for the piles. Such projections or footings as are known in the prior art consist of metal extensions and the like and are reasonably effective as stabilizers when the pile is embedded in hard earth or stone. However, such a metal projection is of little or no value when the pile structure is embedded in less consolidated earth, such as sandy or loose soil. Thus, the need for a method which will effectively secure a pile structure in incompetent earth formations is apparent. Such a method is provided by the invention.

SUMMARY OF THE INVENTION

The invention therefore relates to a method for installing a hollow pile in an earth formation comprising the following steps:

(a) driving said pile into an earth formation, said earth formation tightly engaging the outer surface of said pile along a section thereof when said driving is completed;

(b) placing a closing plate or cement plug at the bottom inner part of the pile;

(c) creating at least one perforation in a section of a wall near the bottom end of the pile and/or in the bottom closing plate or cement plug;

(d) disposing said perforated section of said pile within a weak or unconsolidated portion of said earth formation;

(e) displacing through said pile and said perforation(s) a liquid thermosetting resin-forming composition;

(f) permeating said portion of said formation with said liquid composition in a radially extensive zone that is continuous from within the piling out into said portion; and (g) solidifying said liquid composition in said radially extensive zone to form a consolidated mass integrally comprising said permeated zone and said pile, characterized in that the liquid thermosetting resin-forming composition contains:

10–50%v Epikote-828
10–88%v Ethylacetate
0–78%v Butyloxitol
2–20%v Diethylenetriamine
0–78%v Xylene Epikote 828 is a trade name for a commercial liquid polyglycidyl ether of 2,2-bis(4-hydroxyphenyl)propane, which preferably has an epoxy group content of 5320 mmol/kg.

Butyloxitol is 2-butoxyethanol: $CH_3—(CH_2)_3—O—CH_2—CH_2—OH$

Preferably, the liquid thermosetting resin-forming solution has the following composition:

10–30%v Epikote-828
20–75%v Ethylacetate
0–68%v Butyloxitol
2–5%v Diethylenetriamine
0–50%v Xylene Advantageously the liquid thermosetting resin-forming solution contains 0–15%v DMP-10. DMP-10 is dimethylaminomethylphenol:

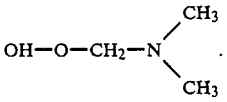

By the addition of this compound to the solution the resin will get better attached to the earth formation in an aqueous environment.

Alternatively, the invention relates to a method for installing a hollow pile in an earth formation in which step (b)—placing a closing plate or cement plug at the bottom inner part of the pile—is carried out before step (a)—driving said pile into an earth formation.

According to a further embodiment of the invention step (c)—creating at least one perforation in a section of the wall near the bottom end of the pile and/or in the bottom closing plate or cement plug—precedes step (a)—driving said pile into an earth formation—and/or step (b)—placing a closing plate of cement plug at the bottom inner part of the pile.

According to a further preferred embodiment of the invention in step (c) at least one narrow hole is drilled through the bottom closing plate or cement plug extending downwards beneath the pile and in step (d) the unconsolidated portion of the earth formation beneath the pile tip is permeated by passing said liquid thermosetting resin-forming composition down the interior of the pile into the hole(s) beneath the pile and into a radially extensive zone of the formation beneath the pile.

The hole(s) created beneath the pile may be stabilized in a number of ways if required to facilitate permeation of the liquid into the soil. Such ways are known to the man skilled in the art and may include hollow perforated tubings and packers among other things.

Broadly, the process according to the present invention comprises stabilizing a structure embedded in an earth formation by disposing the solidifiable liquid resin composition between at least an external portion of the structure and the surrounding earth formation, and solidifying the resin composition in intimate and static contact with both the structure and the formation, whereby the solidified resin is bonded to both the structure and the formation.

BRIEF DESCRIPTION OF THE DRAWING

The FIGURE of the drawing shows the steps of placing a pile into the earth.

DESCRIPTION OF PREFERRED EMBODIMENTS

When according to the present invention resin-forming poly-epoxide composition is flowed, as a liquid, from inside a pile into contact with a surrounding earth formation (especially a granular earth formation) and allowed to harden, the pile demonstrates a pull-out resistance materially exceeding that obtainable by other methods. Similarly, when the resin-forming poly-epoxide composition is flowed as a liquid from a hole created beneath the pile into the surrounding earth formation and allowed to harden, the pile and the earth formation demonstrate a load bearing capacity materially exceeding that obtainable by other methods. Thus, it is possible to reduce both the number of piles necessary to form an adequate foundation and the depth to which such piles must be driven.

The prior art processes of anchoring pilings, such as by forming metal footings or by pouring slurries of concrete, or other cementitious materials around or from within the pile out into the surrounding earth, are subject to serious disadvantages which materially reduce the pullout resistance of the piles and/or load bearing capacity of the soil and the piles when compared with those installed by our new process. More specifically, concrete slurries cannot easily be pumped through permeable formations without fracturing the formations.

Furthermore, cement does not have a high bonding affinity for metal and tends to fracture at the point where it is joined to a metal pile when the latter is subjected to intense or shock-loading pull-out forces.

By using the resin-forming composition according to the invention the aforementioned disadvantages of prior art metal footings or cementitious projections are overcome. The composition according to the invention comprises a pumpable, oil-phase liquid mix which is not affected by water, i.e., it will not dehydrate and become an unpumpable mass, as may concrete or cement. Further, the present liquid compositions solidify at predictable rates in contact with sea water and other aqueous solutions which may affect the curing or setting of cement.

In addition, the present liquid mix may be used to stabilize piles in relatively permeable formations, where prior art cementitious materials are not effective because the suspended solid particles which, in such prior art mixtures, are essential to the formation of a solid grout, filter out on the face of the formation. Since the mix is a solid free, pumpable, oil-phase liquid, the mix cures to a solid whether it is disposed within or adjacent to the matrix of the earth formation and thus it can be cured in either sandy formations or in relatively impermeable formations.

Furthermore, the liquid mix according to the invention will adhere to wet surfaces and solidify to form a much stronger bond to the metal pilings and to the earth formations than any material previously known. Tests have shown that under identical conditions the cured mix exhibited a shear strength of from at least 2 to 100 times as great as that for cementitious compositions. Finally, the solidified resin composition according to the invention is elastic rather than brittle and resists shock better than concrete.

While resin consolidations, especially where the formation is completely saturated with the resin are excellent, the relatively high cost of the resins prohibits many such consolidations.

When the formation to be consolidated must remain permeable, it is not possible to saturate the formation with resins since this would close off the pore space between the adjacent grains of the formations making the resulting consolidated formation completely impermeable. In order to maintain permeability and a corresponding reduction in cost, resins are dispersed in formations in concentrations less than saturating to achieve some consolidation and at the same time maintain permeability. However, when the concentration of the resin is reduced, much of the resin merely collects and coagulates in the pore spaces between adjacent grains of the formation without adding appreciably to the actual consolidation or the compressive strength of the consolidated grains. Therefore, it has been a widespread practice to attempt a compromise between some consolidation and some permeability, when it is necessary that the formation consolidated remain permeable.

The method according to the invention seeks to avoid such compromises by the formation of a hardened resin film covering the surfaces of the loose grains and leaves the pores (interstitial voids) unemcumbered by resin precipitation. In this manner, it is possible to achieve consolidations which are both strong and permeable, and which can be accomplished at a very reasonable expense. Surprisingly, the consolidations accomplished according to the invention are often as strong as those consolidations in which the formation is actually saturated with the resin or resin composition. This means that excellent consolidations can be achieved at a very reasonable cost while maintaining a very high proportion of the original premeability. Permeable consolidations allow the consolidated mass to drain and thereby allow it to sustain much greater loads than in the case in which drainage is not possible. Often, in the practice of the invention, the permeability of the consolidated mass is approximately that of the unconsolidated mass which makes this method extremely desirable for the consolidation in case one desires to repeat the consolidation treatment to give additional strength to part or whole of the initially consolidated mass.

While it has been the practice to treat permeable, unconsolidated or partially consolidated masses with injected resin compositions to obtain consolidation, the consolidation integrity is sometimes sacrificed for purposes of permeability.

The liquid thermosetting resin-forming composition preferably has a dynamic viscosity of at most 10 cP. By using such a composition the soil to be consolidated under and/or around a pile is not disturbed during the injection of the liquid composition therein.

The liquid thermosetting resin-forming composition advantageously differs from other resin-forming compositions in that it remains in a liquid pumpable state for very long periods. Tests have demonstrated that the liquid composition remains in a pumpable state for 24 to 48 hours. During this time no solid particles are produced in the liquid and hardly any increase in viscosity is observed. After this time small viscous masses of resin begin to separate from the liquid.

Long pumping times of the order quoted here are necessary for premeating to a satisfactory extent soils that have very low initial permeability and/or are easily disturbed by the passage of flowing fluids.

Therefore, in the present method, a liquid composition is preferably chosen such that it remains as a one-phase low viscosity liquid for at least 10 hours after mixing at 25° C.

The liquid composition can be injected through holes in the lower cylindrical part of the pile: shaft-grouting. Alternatively, it can be injected through holes in the bottom closing plate of the pile: pile-tip-grouting.

The invention will now be further illustrated by the following Example.

EXAMPLE

Platform A is an offshore piled structure constructed for the exploitation of hydrocarbon reserves. The main part of the structure rests on four legs in 150 m deep sea. Each leg is piled (by a number of hollow steel piles placed symmetrically around the leg) through the seabed to a depth of 120 m below the seabed. The pile tips rest in a weakly cemented, porous calcareous soil of low permeability (20–400 millidarcy) which has subsequently been shown in tests as having insufficient strength to safely bear the load of the platform according to the original design criteria.

Calculations showed that in order to satisfactorily strengthen the soil beneath the pile tips a five-fold increase in soil strength would be required and this must extend up to 1.7 m radially from the axis of the pile and to a depth of 6 m below the pile tip. The volume of epoxy grout required is of the order of 25 cubic meters per pile. An injection hole of 15 cm diameter is drilled through the pile tip into the soil, extending some 6 m beneath the pile tip. The following fluids are injected into the soil taking care not to exceed the estimated fracture pressure of the soil (approximately 12 bar): Fresh water—Isopropyl alcohol—Xylene.

The purpose of these fluids is to pre-condition the formation by removing most of the natural pore water. This is followed by the epoxy grout.

In laboratory tests to evaluate the effectiveness of the epoxy grout actual soil samples from beneath the pile tip of Platform A were treated with the epoxy grout formulation mentioned below. Soil strengths were found to have improved by a factor 10.

The liquid thermosetting resin-forming composition (the so-called epoxy grout) used in this Example had the following composition:

Epikote-828 19.6%v
Xylene 42.1%v
Butyloxitol 5%v
Ethylacetate 30.4%v
Diethylenetriamine 2.9%v

What is claimed is:

1. A process for stabilizing a structure embedded in an earth formation, comprising:

disposing a solidifiable liquid resin composition between at least an external portion of the structure and the surrounding earth formation, said composition containing 10–50%v polyglycidyl ether of 2,2-bis(4-hydroxyphenol)propane, 10–88%v ethylacetate, 0–78%v butyloxitol, 2–20%v diethylenetriamine and 0–78%v xylene; and solidifying the resin composition in intimate and static contact with both the structure and the formation, whereby the solidified resin is bonded to both the structure and the formation.

2. The method of claim 1 wherein said composition includes 0–15%v dimethylaminomethylphenol.

3. A method for installing a hollow pile in an earth formation, comprising the following steps:

driving said pile into an earth formation, said earth formation tighly engaging the outer surface of said pile along a section thereof when said driving is completed;

placing a closing plate at the bottom inner part of the pile;

creating at least one perforation in at least one of (a) the closing plate and (b) a section of the wall near the bottom end of the pile;

disposing said perforated section of said pile within a weak or unconsolidated portion of said earth formation;

displacing through said pile and said perforation a liquid thermosetting resin-forming composition;

permeating said portion of said formation with said liquid composition in a radially extensive zone that is continuous from within the piling out into said portion; and solidifying said liquid composition into the radially extensive zone to form a consolidated mass integrally comprising said premeated zone and said pile, characterized in that the liquid thermosetting resin-forming composition contains 10–50%v polyglycidyl ether of 2,2-bis(4-hydroxyphenol)propane, 10–88%v ethylacetate, 0–78%v butyloxithol, 2–20%v diethylenetriamine and 0–78%v xylene.

4. A method for installing a hollow pile in an earth formation, comprising the following steps:

driving said pile into an earth formation, said earth formation tightly engaging the outer surface of said pile along a section thereof when said driving is completed;

placing a cement plug at the bottom inner part of the pile;

creating at least one perforation in at least one of (a) the cement plug and (b) a section of the wall near the bottom end of the pile;

disposing said perforated section of said pile within a weak or unconsolidated portion of said earth formation;

displacing through said pile and said perforation a liquid thermosetting resin-forming composition;

permeating said portion of said formation with said liquid composition in a radially extensive zone that is continuous from within the piling out into said portion; and solidifying said liquid composition into the radially extensive zone to form a consolidated mass integrally comprising said premeated zone and said pile, characterized in that the liquid thermosetting resin-forming composition contains 10–50%v polyglycidyl ether of 2,2-bis(4-hydroxyphenol)propane, 10–88%v ethylacetate, 0–78%v butyloxithol, 2–20%v diethylenetriamine and 0–78%v xylene.

5. The method of any one of claims 3 and 4 wherein at least one of the second and third steps precedes the first step.

* * * * *